US009512624B2

(12) United States Patent
Owens et al.

(10) Patent No.: US 9,512,624 B2
(45) Date of Patent: Dec. 6, 2016

(54) WALL TRIM FINISHING APPARATUS

(71) Applicants: Mark Vernon Owens, Kansas City, MO (US); Clayton Scott Bohm, Garden City, MO (US)

(72) Inventors: Mark Vernon Owens, Kansas City, MO (US); Clayton Scott Bohm, Garden City, MO (US)

( * ) Notice: Subject to any disclaimer, the term of this patent is extended or adjusted under 35 U.S.C. 154(b) by 0 days.

(21) Appl. No.: 14/484,436

(22) Filed: Sep. 12, 2014

(65) Prior Publication Data

US 2015/0087213 A1 Mar. 26, 2015

Related U.S. Application Data

(60) Provisional application No. 61/880,496, filed on Sep. 20, 2013.

(51) Int. Cl.

| | |
|---|---|
| ***E04F 19/02*** | (2006.01) |
| ***B24D 15/02*** | (2006.01) |
| ***E04F 21/00*** | (2006.01) |
| ***B24D 15/04*** | (2006.01) |

(52) U.S. Cl.

CPC ..... *E04F 19/02* (2013.01); *B24D 15/023* (2013.01); *B24D 15/04* (2013.01); *E04F 21/0069* (2013.01)

(58) Field of Classification Search

CPC ..... B24D 15/023; B24D 15/04; E04F 19/02; E04F 21/0069

USPC ..... 451/495, 523

See application file for complete search history.

(56) References Cited

U.S. PATENT DOCUMENTS

| | | | | |
|---|---|---|---|---|
| 1,570,177 | A * | 1/1926 | Pointer | B24D 15/00 15/231 |
| 2,717,422 | A * | 9/1955 | Rowe | B24D 18/00 249/83 |
| 4,535,574 | A * | 8/1985 | Dettelbach | B24D 3/001 264/46.4 |
| 4,668,248 | A * | 5/1987 | Dettelbach | B24D 13/12 451/542 |
| 4,887,396 | A * | 12/1989 | Lukianoff | B24D 15/04 451/523 |
| 5,131,193 | A * | 7/1992 | Demers | B24D 15/023 451/490 |
| 5,292,465 | A * | 3/1994 | Kobayashi | B29C 44/04 264/266 |
| 2004/0033770 | A1 * | 2/2004 | Tchernov | B24D 15/02 451/523 |

(Continued)

*Primary Examiner* — Joseph J Hail
*Assistant Examiner* — Marc Carlson
(74) *Attorney, Agent, or Firm* — David J. Ream

(57) ABSTRACT

A wall trim finishing apparatus includes a base member having a bottom surface. The bottom surface is configured to mate with, and apply relatively even force to, at least one curve or crevice of a front surface of a piece of wall trim. The bottom surface may be configured to receive a piece of sandpaper or absorbent material between the bottom surface of the base member and the front surface of the wall trim. Sandpaper coupled to the bottom surface of the base member creates a sanding apparatus. The bottom surface may be divided into a first portion and a second portion by a channel defined therebetween that is configured to accumulate sanding residue generated when the bottom surface is mated to and moved along the front surface of the wall trim. Sand paper is adhesively adhered to both portions.

6 Claims, 9 Drawing Sheets

(56) References Cited

U.S. PATENT DOCUMENTS

| | | | | |
|---|---|---|---|---|
| 2007/0099551 | A1* | 5/2007 | Walsh | B24D 15/023 451/523 |
| 2012/0122379 | A1* | 5/2012 | McDonell | B24D 15/023 451/442 |

* cited by examiner

WALL TRIM FINISHING APPARATUS

REFERENCE TO RELATED APPLICATIONS

This application claims the benefit of provisional patent application U.S. Ser. No. 61/880,496 filed Sep. 20, 2013 titled Wall Trim Finishing Apparatus.

BACKGROUND OF THE INVENTION

This invention relates generally to construction and material finishing tools and, more particularly, to a wall trim finishing apparatus that is configured to provide relatively even force to the front surface of a piece of wall trim.

Finishing wall trim is a tedious and time-consuming process. First, the front surface is cleaned. Second, the front surface is sanded. Third, the front surface is cleaned again. Fourth, a first coat of coating material such as primer, paint, stain, or varnish is applied. Then the front surface is sanded again, cleaned again, and coated again. This cycle is repeated until the wall trim is finished.

The process is even more tedious when wall trim front surfaces define curves and/or crevices. These curves and crevices create ornamental features in the wall trim. These curves and crevices also often require multiple passes of cleaning, sanding, and/or coating.

Various devices have been proposed in the prior art to alleviate some of the frustration experienced when trying to finish a piece of wall trim that includes ornamental features. Although assumably effective for their intended purposes, the current devices do not provide even force to the front surface of a piece of wall trim. For instance, one solution is to use compressible material that forms to the contours of the front surface of the wall trim. As the compressible material forms to the curves, crevices, and planes of the wall trim, uneven forces are created. When sanding the wall trim, uneven forces can potentially destroy the ornamental features of the wall trim. When coating the wall trim, uneven forces can result in runs developing in the coating material and/or leave behind thin areas of coating material.

Therefore, it would be desirable to have a finishing apparatus that is configured to provide relatively even force to a front surface of wall trim. Further, it would be desirable to have a finishing apparatus that could simultaneously sand multiple curves and/or crevices without destroying the ornamental features of the wall trim. In addition, it would be desirable to have a fluid applicator that is capable of providing a relatively even coat of coating material to the front surface of the wall trim.

SUMMARY OF THE INVENTION

A wall trim finishing apparatus according to the present invention includes a base member having a bottom surface. The bottom surface of the base member is configured to mate with at least one curve and/or crevice of a front surface of wall trim. The bottom surface may also be configured to receive a piece of sandpaper and/or absorbent material between the bottom surface of the base member and the front surface of the wall trim so as to accommodate cleaning, sanding, and/or coating the wall trim.

Therefore, a general object of this invention is to provide a finishing apparatus configured to clean, sand, and/or coat a front surface of a piece of wall trim.

Another object of this invention is to provide a finishing apparatus, as aforesaid, that is capable of applying relatively even force to a front surface of wall trim.

Still another object of this invention is to provide a finishing apparatus, as aforesaid, that is capable of providing relatively accurate and relatively easy blending of two pieces of wall trim at a butt joint.

Still another object of this invention is to provide a finishing apparatus, as aforesaid, that may be altered to more perfectly mate with a front surface of wall trim with or without accommodating a piece of sandpaper and/or a piece of absorbent material.

Still another object of this invention is to provide a finishing apparatus, as aforesaid, that may be modified to allow it to sand already hung trim without damaging adjacent walls, trim, and/or floors.

Still another object of this invention is to provide a finishing apparatus, as aforesaid, that accommodates easily switching pieces of sandpaper and/or pieces of absorbent material.

Yet another object of this invention is to provide a finishing apparatus, as aforesaid, that is easily portable, easy to use, and inexpensive to fabricate.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1A:
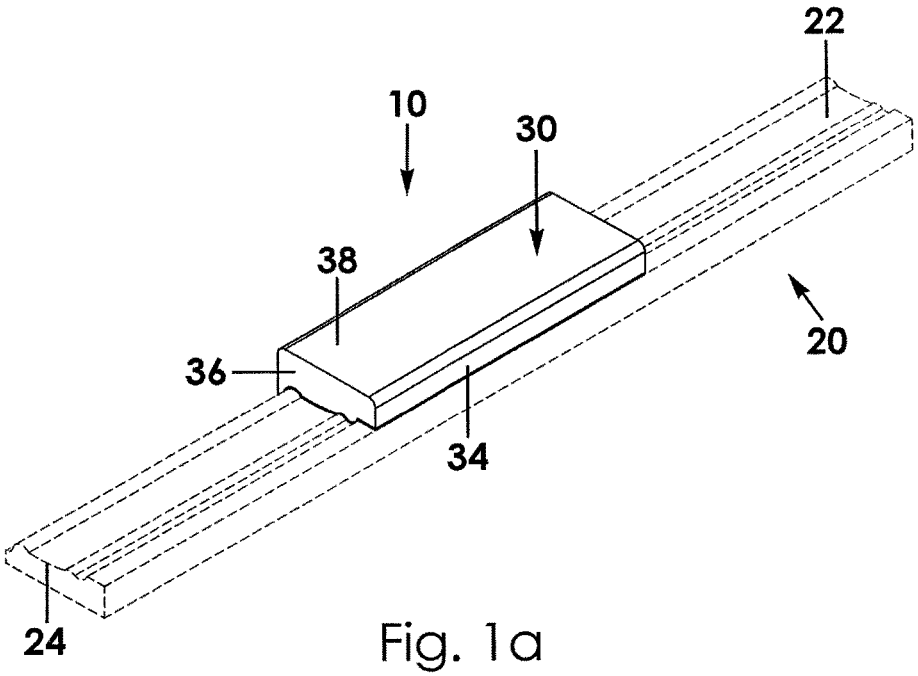
FIG. 1*a* is a perspective view of a finishing apparatus, according to a preferred embodiment of the present invention, mated to a piece of wall trim.
Figure 1B:
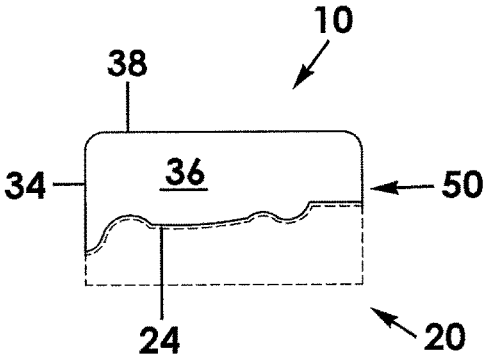
FIG. 1*b* is an end view of the finishing apparatus mated to a piece of wall trim, as in FIG. 1*a;*
Figure 2A:
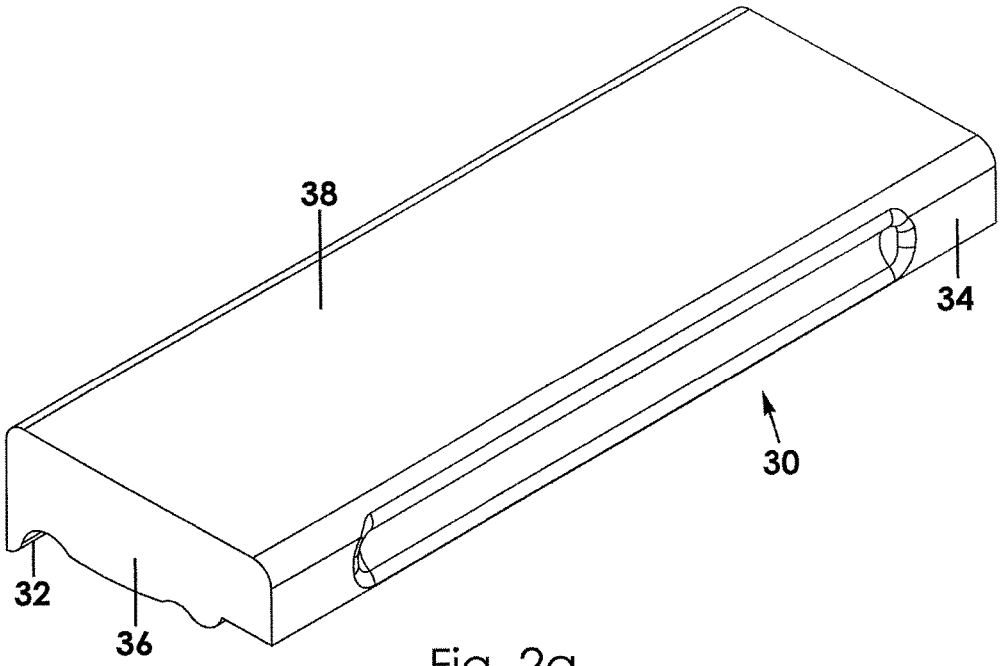
FIG. 2*a* is a perspective view of the finishing apparatus, as in FIG. 1*a*, removed from the piece of wall trim.
Figure 2B:
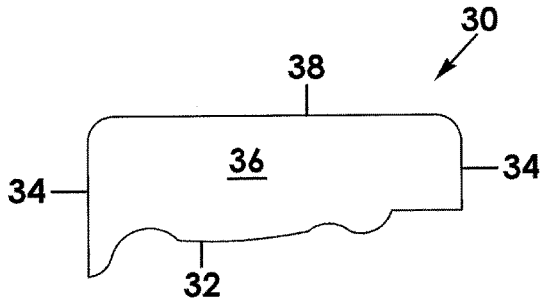
FIG. 2*b* is an end view of the finishing apparatus, as in FIG. 2*a;*
Figure 3A:
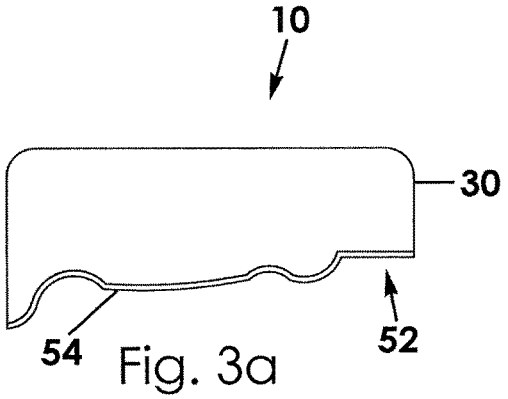
FIG. 3*a* is an end view of the finishing apparatus, as in FIG. 2*b*, with a piece of sandpaper coupled to a bottom surface of the finishing apparatus.
Figure 3B:
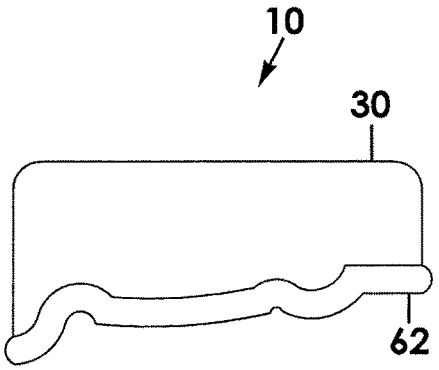
FIG. 3*b* is an end view of the finishing apparatus, as in FIG. 2*b*, with a piece of absorbent material coupled to a bottom surface of the finishing apparatus.
Figure 4A:
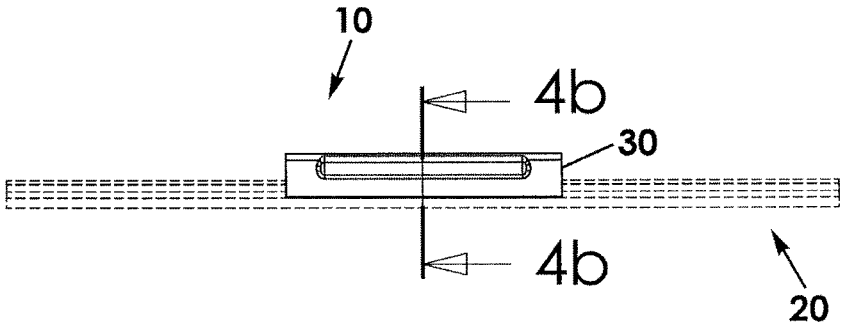
FIG. 4*a* is a side view of the finishing apparatus mated to a piece of wall trim, as in FIG. 1*a;*
Figure 4B:
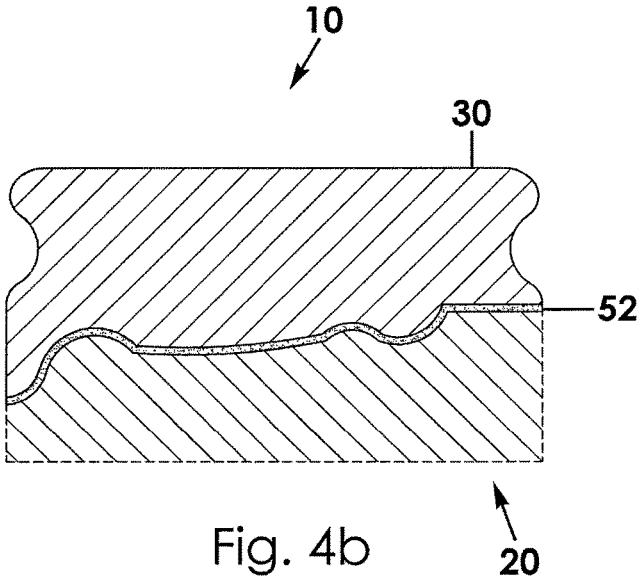
FIG. 4*b* is a sectional view taken along line 4*b*-4*b* of FIG. 4*a;*

A wall trim finishing apparatus according to a preferred embodiment of the present invention will now be described in detail with reference to FIGS. 1*a* to 4*b* of the accompanying drawings. The phrase "wall trim" means any wall trim, molding, rail, spindle, or similar elongate member having at least one surface (a "front surface") that defines at least one curve, crevice, and/or plane. The present invention provides benefits for finishing almost any wall trim, but its benefits are most pronounced for wall trim having a cross section that is relatively constant along a measurable length of the wall trim.

The finishing apparatus 10 includes a base member 30 having a bottom surface 32 configured to selectively communicate with a front surface 22 of a piece of wall trim 20. The finishing apparatus 10 may be a sanding apparatus 10, a fluid applicator 10, or any similar apparatus that may be used to finish the wall trim 20.

The base member 30 may include opposed side surfaces 34, opposed end surfaces 36, and a top surface 38 generally opposed to the bottom surface 32. Any or all of the respective side 34, end 36, and top 38 surfaces may be ergonomically configured to enable a user to grasp the base member 30 comfortably and securely so as to move the base member 30 along a length of the wall trim 20 while applying a relatively even force between the bottom surface 32 of the base member 30 and the front surface 22 of the wall trim 20.

In one embodiment, the finishing apparatus 10 is a sanding apparatus 10. The bottom surface 32 of the base member 30 of the sanding apparatus 10 may be configured to communicate with the front surface 22 of the wall trim 20 so as to enable a user to simultaneously generate relatively even friction between the sanding apparatus 10 and at least one curve, crevice, and/or plane of the front surface 22 of the wall trim 20 when the sanding apparatus 10 is moved along a length of the wall trim 20. In one embodiment, the bottom surface 32 of the base member 30 may be pre-impregnated with abrasive material. In another embodiment, a piece of sandpaper 52 may be coupled to the bottom surface 32 of the base member 30 such that an abrasive surface 54 of the sandpaper 52 contacts the front surface 22 of the wall trim 20 when the base member 30 is moved along a length of a single piece of wall trim 20 and/or across a butt joint (not shown) defined by two pieces of wall trim 20 that are coupled to a wall (not shown) or other similar structure.

The finishing apparatus 10 may be modifiable to prevent damage to carpet or other flooring when using the finishing apparatus 10 to sand, clean, and/or coat a piece of wall trim that is coupled to a wall (not shown). The method of modification may be by means of a hand saw, a power saw, a wood rasp, or any similar device capable of removing a portion of one or both sides of the finishing apparatus.

The bottom surface 32 of the base member 30 may define a recessed area 50 when located relative to the front surface 22 of the wall trim 20 so as to accommodate the sandpaper 52. The recessed area 50 may perfectly match the front surface 22 of the wall trim 20. In one embodiment, to accommodate a scenario where the recessed area 50 does not perfectly match the front surface 22 of the wall trim 20, the base member 30 may be made at least partially of a sandable material. A user may alter the bottom surface 32 of the base member 30 by coupling the sandpaper 52 to the front surface 22 of the wall trim 20 and moving the base member 30 along the length of the sandpaper 52 such that the abrasive surface 54 of the sandpaper 52 is in contact with the bottom surface 32 of the base member 30. The user may continue to move the base member 30 along the length of the sandpaper 52 until the bottom surface 32 of the base member 30 more perfectly matches the front surface 22 of the wall trim 20.

The finishing apparatus 10 may easily switch between sandpaper 52 having abrasive surfaces 54 with various qualities and classifications so as to accommodate various applications. The qualities and classifications of course, medium, and fine sandpaper 52 is well known in the art. Additionally, the corresponding uses of preparing wood, sanding primer coats, and sanding finishing coats are also well known in the art.

In another embodiment, the finishing apparatus 10 is a fluid applicator 10. The bottom surface 32 of the base member 30 of the fluid applicator 10 may be configured to communicate with the front surface 22 of the wall trim 20 so as to enable a user to simultaneously apply relatively even layers of fluid to at least one curve, crevice, and/or plane of the front surface 22 of the wall trim 20 when the fluid applicator 10 is moved along a length of the wall trim 20. In one embodiment, the bottom surface 32 of the base member 30 may be manufactured from absorbent material. In another embodiment, a piece of absorbent material 62 may be coupled to the bottom surface 32 of the base member 30 such that fluid in the absorbent material 62 may flow from the absorbent material 62 to the front surface 22 of the wall trim 20 when the base member 30 is moved along a length of the wall trim 20. The bottom surface 32 of the base member 30 may define a void 50 when located relative to the front surface 22 of the wall trim 20 so as to accommodate the absorbent material 62.

The finishing apparatus 10 may be fabricated by cutting the bottom surface 32 of the base member 30 so that the bottom surface 32 of the base member 30 is configured to mate with the front surface 22 of the wall trim 20 for longitudinal movement therealong. Alternatively, the bottom surface 32 of the base member 30 may be cut with a predetermined offset relative to the front profile 24 of the wall trim 20 so that the base member 30 defines a recess 50 between the bottom surface 32 of the base member 30 and the front surface 22 of the wall trim 20 when the base member 30 is located relative to the wall trim 20. The recess may be configured to accommodate a piece of sandpaper 52 or a piece of absorbent material between the bottom surface 32 of the base member 30 and the front surface 22 of the wall trim 20.

One method of fabricating the finishing apparatus 10 may include fabricating a cutting tool (not shown) having a cutting edge (not shown) that defines a tooling profile (not shown). A waterjet cutting machine may be used to fabricate the cutting tool 110. The tooling profile (not shown) may be substantially similar to a front profile 24 defined by the front surface 22 of the wall trim 20. The bottom surface 32 of the base member 30 may then be cut with the cutting tool (not shown) so that the bottom surface 32 of the base member 30 is configured to mate with the front surface 22 of the wall trim 20 for longitudinal movement therealong. The same fabrication method—such as the use of a dxf file with a CNC Motion Control machine—that is used to fabricate molding knives (not shown) for trim may be used to fabricate the cutting tool (not shown). In such a circumstance, the bottom surface 32 of the base member 30 is designed to perfectly match the front surface 22 of the wall trim 20.

The method may also include designing the tooling profile (not shown) of the cutting edge (not shown) of the cutting tool (not shown) so that the bottom surface 32 of the base member 30 is configured to create a recessed area relative to the front surface 22 of the wall trim 20. The recessed area may be designed to accommodate a piece of sandpaper or a piece of absorbent material between the bottom surface 32 of the base member 30 and the front surface 22 of the wall trim 20.

Another method of fabricating the finishing apparatus 10 may include utilizing a hot wire to cut the bottom surface 32 of the base member 30 to a predetermined configuration. The hot wire may be installed in, and guided by, a CNC Motion Control machine. The same control method—such as the use of a dxf file—that is used to fabricate molding knives (not shown) for trim may be used to cut the bottom surface 32 of the base member 30. In such a circumstance, the bottom surface 32 of the base member 30 is designed to perfectly correspond with the front surface 22 of the wall trim 20.

In use, the finishing apparatus 10 facilitates sanding, cleaning, and coating a piece of wall trim 20. The method of fabricating the finishing apparatus 10 enables a manufacturer to produce a finishing apparatus 10 with a bottom surface 32 that perfectly matches a front surface 22 of a piece of wall trim 20. By perfectly matching the front surface 22 of a piece of wall trim 20, a user can apply relatively even force along various curves and crevices of the front surface 22 of the wall trim 20. This capability enables a user to sand and/or coat the entire front surface 22 of the wall trim 20 in one pass without sanding off ornamental features of the wall trim 20 or leaving runs and/or thin areas in the coating material.

A finishing apparatus 10' according to another embodiment will now be described with reference to FIGS. 5*a* to 9*b* of the accompanying drawings. The finishing apparatus 10' includes a construction substantially similar to the finishing apparatus 10 described above except as specifically noted below. Primed reference numerals will be used for structures that refer to the same or substantially similar structures previously described.

Figure 5A:
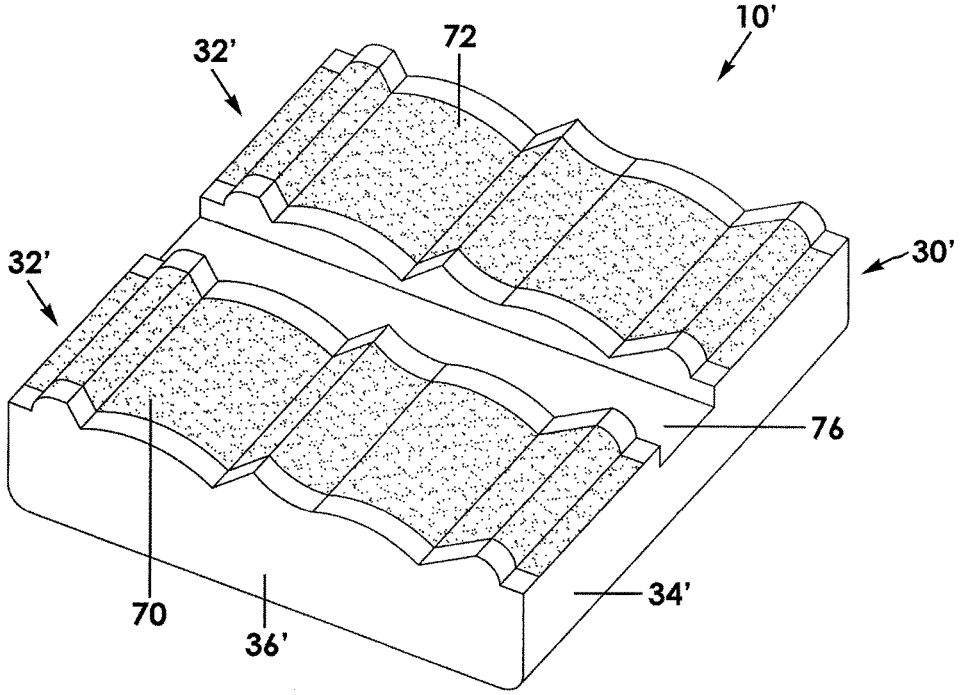
FIG. 5*a* is a perspective view of a finishing apparatus according to another embodiment of the present invention.
Figure 5B:
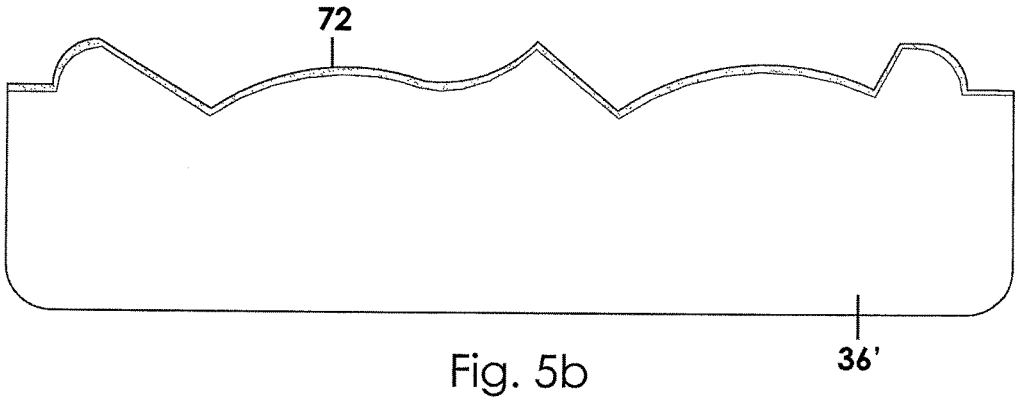
FIG. 5*b* is an end view of the finishing apparatus as in FIG. 5*a;*
Figure 7A:
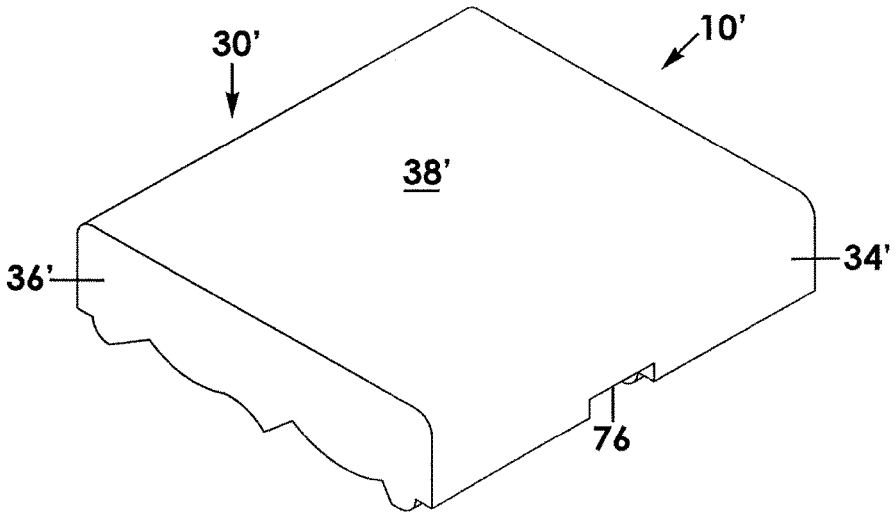
FIG. 7*a* is an inverted perspective view of the finishing apparatus as in FIG. 5*a;*
Figure 7B:
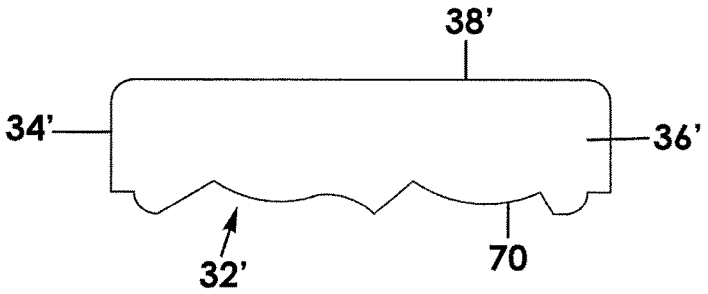
FIG. 7*b* is an end view of the finishing apparatus as in FIG. 7*a;*
Figure 8A:
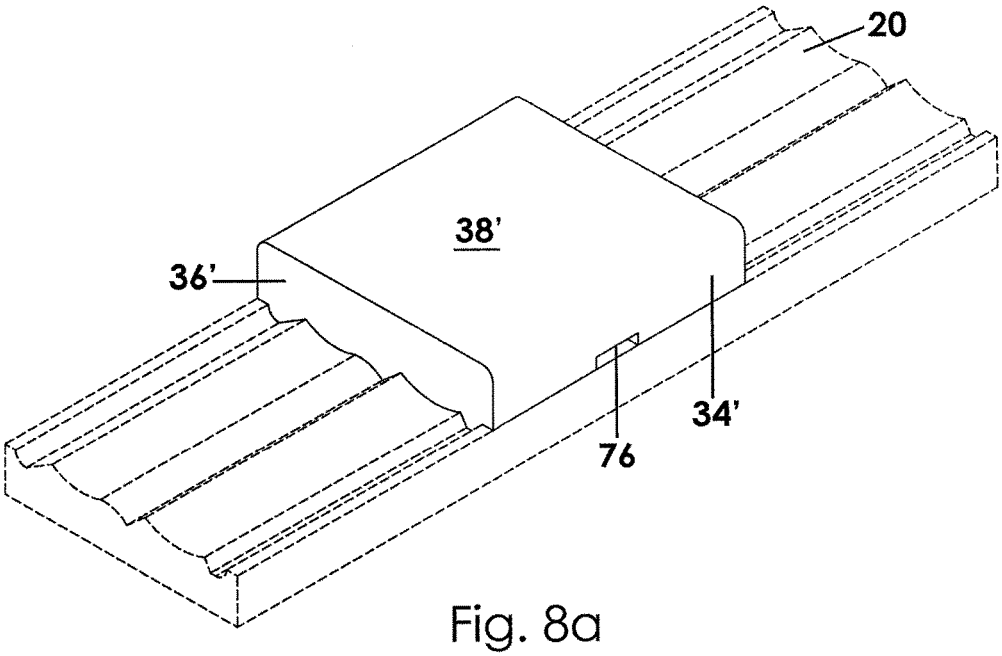
FIG. 8*a* is another perspective view of the finishing apparatus as in FIG. 7*a* in use with a piece of wall trim.
Figure 8B:
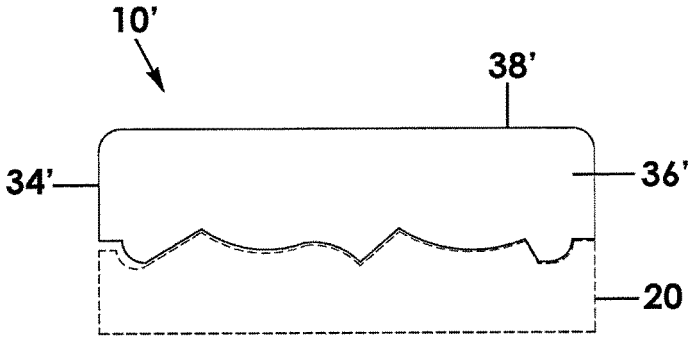
FIG. 8*b* is an end view of the finishing apparatus as in FIG. 8*a;*
Figure 9A:
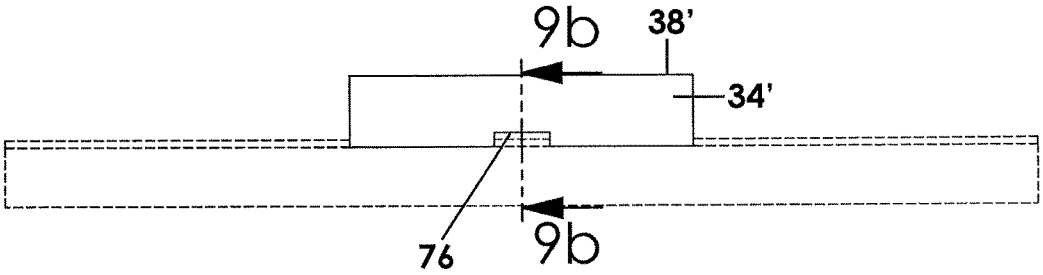
FIG. 9*a* is a side view of the finishing apparatus as in FIG. 8*a*.
Figure 9B:
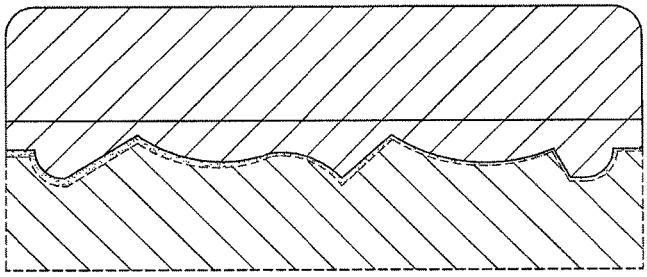
FIG. 9*b* is a sectional view taken along line 9*b*-9*b* of FIG. 9*a*.

In the manner described previously, the finishing apparatus 10' includes a base member 30' having a bottom surface 32' (as will be described further below) and an opposed front surface 22' (FIG. 7*a*). The base member 30' also includes opposed end surfaces 36' and side surfaces 34' extending longitudinally between the end surfaces 36' (FIG. 5*a*). The finishing apparatus 10' differs from the embodiment first described above in that the bottom surface 32' includes a first bottom portion 70 displaced from a second bottom portion 72 by a channel 74 that extends laterally between respective side surfaces 34' (FIG. 5*a*).

More particularly, the bottom surface 32' of the base member 30' defines a channel 74 extending between respective side surfaces 34'. The channel 74 is situated about midway between end surfaces 36' so as to divide the bottom surface 32' into two portions having generally equal dimensions and substantially similar configurations. In this manner, the first bottom portion 70 is positioned adjacent one end surface 36' of the base member 30' and the second bottom portion 72 is positioned adjacent another end surface 36'. Preferably, each of the first bottom portion 70 and second bottom portion 72 include outwardly extending relief features that are complementary to the inwardly defined curves, crevices, and planes of the wall trim 20 as described previously. In other words, the configuration of the surfaces of the bottom portions are opposite the configurations of the wall trim such that the configurations mate with one another. In use, the spaced apart bottom portions are configured to mate with the inwardly directed voids of the wall trim such that the base member 30' may be moved longitudinally therealong.

The channel 74 has a recessed configuration such that the first bottom portion 70 and second bottom portion 72 extend away from the channel 74. Viewed another way, the bottom portions extend upwardly and the channel 74 forms a recess or valley sandwiched therebetween (FIG. 5*a*). The channel 74 includes a dimension and configuration so as to receive residue (such as saw dust) that is generated when the finish apparatus 10' is used to sand the surface of a piece of wall trim. For instance, when the first bottom portion 70 and second bottom portion 72 of the base member 30' are positioned in a mating relationship with the front surface of a piece of wall trim 20 and moved longitudinally therealong, the dust generated by sanding is able to be collected in the channel 74 rather than accumulating on the wall trim 20 itself, causing undesirable friction or scratches, or the like.

Figure 6A:
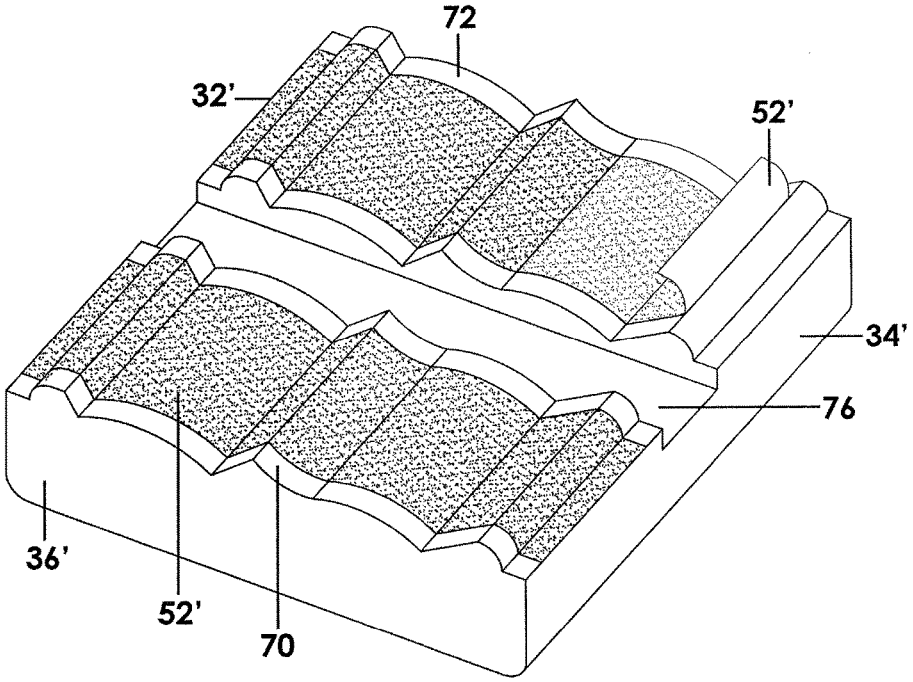
FIG. 6*a* is a perspective view of the finishing apparatus as in FIG. 5*a* illustrated with a portion of adhesively attached sandpaper being applied to the base member.
Figure 6B:
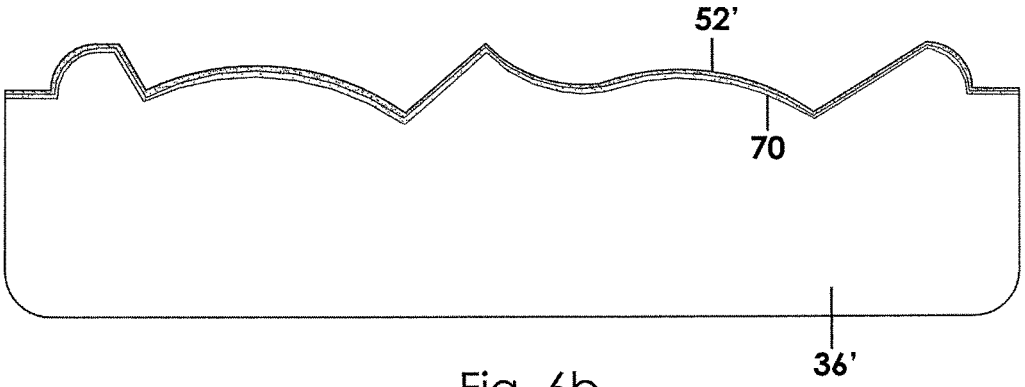
FIG. 6*b* is an end view of the finishing apparatus as in FIG. 6*a;*

Individual strips of sandpaper 52' may be coupled to the bottom portions 70 and 72. Specifically, one strip of sandpaper 52' may be coupled to the first bottom portion 70 and a separate and distinct strip of sandpaper 52' may be coupled to the second bottom portion 72. The strips of sandpaper 52' may be adhered to respective bottom portions with adhesive such that they may be peeled off, removed, and replaced. FIG. 6*a* illustrates a piece of sandpaper being partially applied/removed. In the embodiment illustrated in FIGS. 5*a* and 5*b*, the actual surface of bottom portions 70 and 72 may be impregnated with an abrasive material or simulated texture so as to be applied directly to a piece of wall trim 20.

In use, the finishing apparatus 10' may be used in substantially the same manner as described above. However, residue generated through a sanding operation is conveniently collected in the channel 74 and, as a result, reduces any interference with a smooth sanding operation and reduces the potential mess of residue accumulation. In addition, the adhesive attachment of sandpaper to each individual bottom portion enables a user to quickly and conveniently cycle through different grades of sandpaper when finishing a piece of wall trim.

It is understood that while certain forms of this invention have been illustrated and described, it is not limited thereto except insofar as such limitations are included in the following claims and allowable functional equivalents thereof.

The invention claimed is:

1. A finishing apparatus for use in finishing wall trim having a front surface contour that includes at least one curve, or crevice extending longitudinally along its length, said finishing apparatus, comprising:

a base member having a top surface and a bottom surface opposed to said top surface and having longitudinally spaced opposed end surfaces extending between ends of said top surface and said bottom surface and having laterally spaced opposed side surfaces extending between sides of said top surface and said bottom surface;

wherein said bottom surface comprises a plurality of shaped surfaces connected laterally between said opposed side surfaces to substantially match said front surface contour of said wall trim;

wherein said plurality of shaped surfaces extend longitudinally between said opposed end surfaces so said bottom surface mates with said front surface contour of said wall trim in a friction fit relationship for a relative longitudinal movement therealong;

wherein said bottom surface includes only a single channel that laterally cuts through said plurality of shaped surfaces and said opposed side surfaces with a depth deeper than all of said plurality of shaped surfaces to fully divide said plurality of shaped surfaces into a first bottom portion and a second bottom portion where the two portions are longitudinally separated by the channel and include substantially similar dimensions and substantially similar configurations;

wherein said channel allows for residue to accumulate between said first and second portions during a finishing operation on said wall trim.

2. The finishing apparatus as in claim 1, wherein said first bottom portion and said second bottom portion of said base member are impregnated with an abrasive material.

3. The finishing apparatus as in claim 1, comprising a piece of sandpaper coupled to each of said first bottom portion and to said second bottom portion of said base member.

4. The finishing apparatus as in claim 3, wherein said each piece of sandpaper is removably coupled to said first bottom portion and to said second bottom portion, respectively, of said base member.

5. The finishing apparatus as in claim 1, wherein said first bottom portion is adjacent one of said end surfaces of said base member and said second bottom portion is adjacent another said end surfaces of said base member.

6. The finishing apparatus as in claim 4, wherein said each piece of sandpaper is adhesively coupled to said first bottom portion and to said second bottom portion, respectively, of said base member.

* * * * *